United States Patent [19]

Lewis

[11] Patent Number: 5,069,765

[45] Date of Patent: Dec. 3, 1991

[54] METHOD OF MANUFACTURING COMBUSTIBLE GASEOUS PRODUCTS

[76] Inventor: Arlin C. Lewis, P.O. Box AU, Libby, Mont. 59923

[21] Appl. No.: 508,488

[22] Filed: Apr. 11, 1990

Related U.S. Application Data

[63] Continuation of Ser. No. 198,741, May 25, 1988, abandoned.

[51] Int. Cl.[5] ..... C01B 31/00

[52] U.S. Cl. ..... 204/173; 204/170; 48/65; 48/202; 48/204

[58] Field of Search ..... 204/168, 170, 173; 48/65, 202, 204

[56] References Cited

U.S. PATENT DOCUMENTS

| | | | |
|---|---|---|---|
| 507,975 | 10/1893 | De Neal | 48/65 |
| 603,058 | 4/1898 | Eldridge et al. | 204/164 |
| 625,252 | 5/1899 | Eldridge et al. | 48/65 |
| 935,344 | 9/1909 | White | 48/65 |
| 1,056,045 | 3/1913 | Murray | 204/170 |
| 1,068,788 | 7/1913 | Lahaussois | 48/65 |
| 1,146,776 | 7/1915 | Wallman | 48/202 |
| 1,286,577 | 12/1918 | Freuler | 48/202 |
| 1,857,799 | 5/1932 | Winkler | 48/65 |
| 1,937,552 | 8/1934 | Davis | 48/65 |
| 1,974,125 | 9/1934 | Soelberg | 48/65 |
| 2,094,027 | 9/1937 | Stitzer | 48/65 |
| 3,870,611 | 3/1975 | Vestal | 204/168 |
| 4,052,173 | 10/1977 | Schulz | 48/202 |
| 4,566,961 | 1/1986 | Diaz et al. | 204/168 |

*Primary Examiner*—John Niebling
*Assistant Examiner*—Steven P. Marquis
*Attorney, Agent, or Firm*—Bacon & Thomas

[57] ABSTRACT

An electric arc is used for reacting carbonaceous materials and water to produce a combustible gaseous product comprising hydrogen, carbon monoxide and methane as its major components, wherein the electrothermal and photochemical effects of the arc result in the production of active chemical species which cause and participate in the gasification reactions.

7 Claims, 1 Drawing Sheet

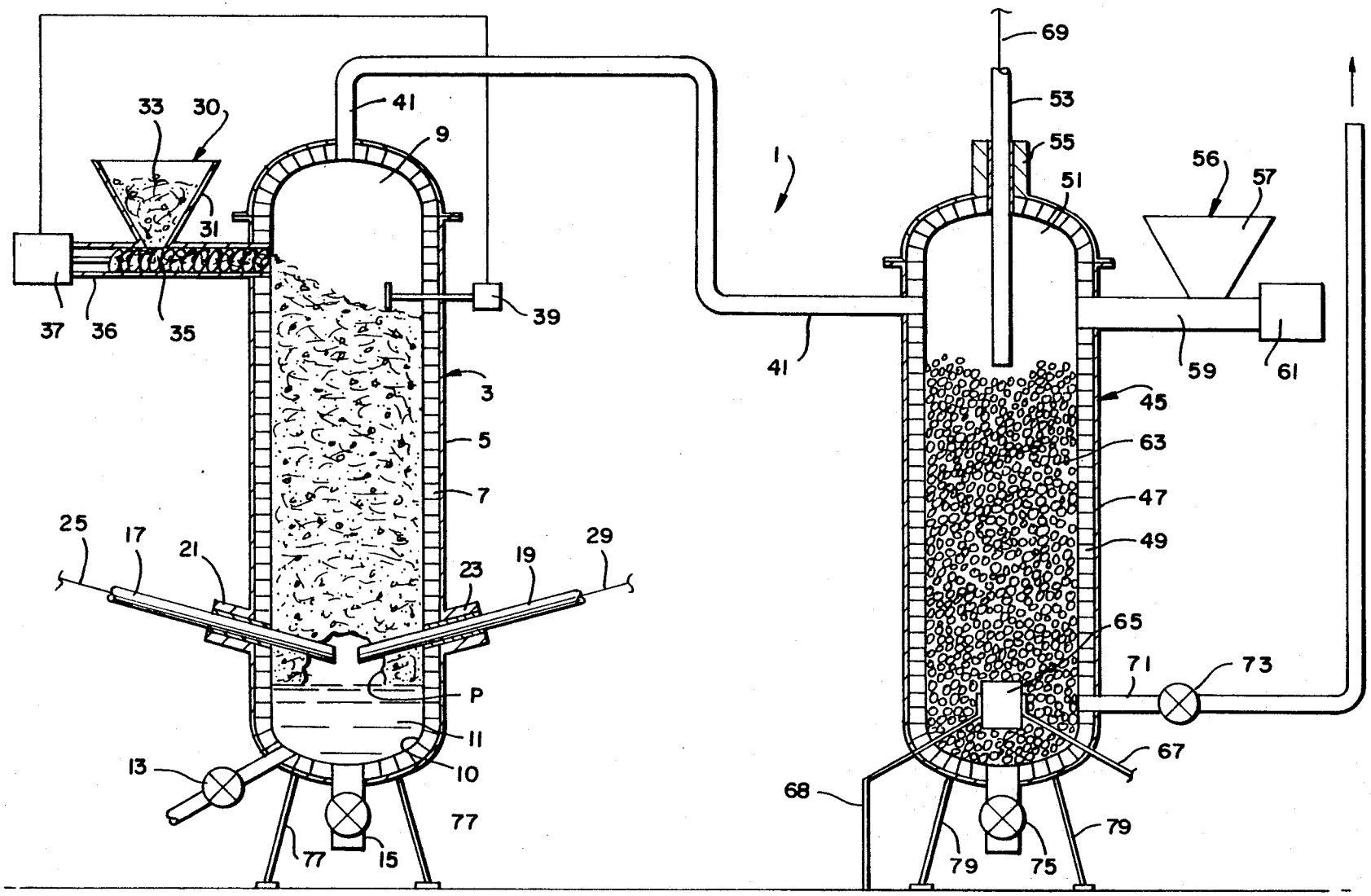
1
3
5
7
9
10
11
13
15
17
19
21
23
25
29
30
31
33
35
36
37
39
41
45
47
49
51
53
55
56
57
59
61
63
65
67
68
69
71
73
75
77
79
P

METHOD OF MANUFACTURING COMBUSTIBLE GASEOUS PRODUCTS

This application is a continuation of application Ser. No. 07/198,741 filed May 25, 1988.

BACKGROUND OF THE INVENTION

1. Field of the Invention

The present invention generally involves the field of technology pertaining to the production of combustible gaseous products from the reaction of water and carbonaceous materials. More particularly, the invention relates to an improved method for the manufacture of combustible gaseous products wherein the gasification reactions are activated by means of an electric arc.

2. Description of the Prior Art

It is known to produce a combustible gas product comprised principally of hydrogen and carbon monoxide by the water gas system wherein water or steam is reacted with incandescent carbonaceous material. This is typically realized through a two-step operation wherein a bed of carbonaceous material, such as coke, is first oxidized by passing air therethrough until the material becomes incandescent and, in the second step, passing stream through the incandescent material to yield the product gases, including hydrogen and carbon monoxide according to the following chemical equation:

$$H_2O + C \rightarrow H_2 + CO$$

The bed of coke is cooled during the second step, and the first step of air oxidation must be repeated in order to reheat the bed.

It is also known to heat the bed of carbonaceous material electrothermally by using carbon or graphite electrodes. This is realized by placing the electrodes in contact with the material and applying a sufficient electrical potential to the electrodes, thereby causing resistive heating of the material to sufficiently elevated temperatures which result in the gasification reactions. Water required for the gasification reactions is provided in the form of injected steam or as water vapor from a reservoir disposed at the bottom of the reactor vessel. In addition to utilizing electrodes for resistive heating, it is further known to carry out the water gas reaction by utilizing an electric arc for heating the material to the required elevated temperatures.

Known methods for manufacturing combustible gases are primarily limited to very specific carbonaceous materials, such as coke or the like, and cannot be applied to the gasification of a feed source that comprises a wide variety of carbonaceous materials, particularly where the objective involves the production of a clean burning fuel gas or a clean synthesis gas for application in the chemical industry. Conventional technology has not been proven commercially successful for the efficient gasification of varied waste products, such as refuse derived fuel (RDF), and forest, industrial, or agricultural wastes. Recovery of energy from these materials is commonly accomplished by the Mass Burn process with attendant low energy recovery efficiency and residue disposal problems, or by fluidized bed combustion processes which yield a low BTU gas when operated in the gasification mode.

The technical and economic deficiencies of the prior art technology described herein for the production of combustible gases are well known. There exists a need for an energy efficient and environmentally acceptable method for the manufacture of combustible gases from a wide variety of carbonaceous materials.

SUMMARY OF THE INVENTION

It is an object of the present invention to provide a method and apparatus for the efficient manufacture of combustible gases through the gasification of a wide variety of carbonaceous materials.

It is another object of the invention to provide an improved system for efficiently gasifying a variety of carbonaceous materials wherein the chemical gasification reactions are both photochemically and electrothermally activated.

It is a further object of the invention to provide a system for the gasification of carbonaceous materials by using electrical energy to photochemically and electrothermally activate the gasification reactions in a manner requiring lower energy consumption than a system utilizing only electrothermal activation.

It is yet another object of the invention to provide an improved method and apparatus for the economic and efficient manufacture of combustible gases from a wide variety of carbonaceous materials by means of an electric arc.

It is again a further object of the invention to provide an improved system for the destruction of hazardous organic wastes and their conversion to safe clean burning fuel gases.

These and other objects of the invention are realized by feeding a charge of carbonaceous materials into the top of a primary reactor that is provided with electrodes disposed adjacent its bottom portion for creating an electric arc zone. A constant level of charge is maintained in the reactor and a supply of water for vaporization by the arc is maintained at a level just below the arc zone. When a continuous electric arc is maintained at the electrodes, the intense heat of the arc creates an "arc pocket" in the feed charge at the arc zone, thereby exposing the downwardly fed charge at the periphery of the pocket and the gases and vapors within the pocket to the thermal and photochemical effects of the arc.

The resulting reactions occurring in the arc zone and in the lower portion of the charge produce a raw product gas which rises upwardly through the downwardly moving charge in countercurrent heat exchange therewith so that the early stages of pyrolysis are initiated at approximately the middle of the charge height. Thus the products of partial pyrolysis are added to the upwardly moving gases. The pyrolysis products include combustible gases, carbon dioxide, and condensable products including tars and gums. The tars and gums deposit on the cool incoming charge particles and are refluxed to the reaction zones lower in the reactor. The noncondensable gaseous products and the carbon dioxide are passed completely through the charge and become part of the raw product gas removed from the top of the primary reactor.

The raw product gas is thereafter fed into the top of a secondary reactor within which is contained a charge of coke. An electrode is provided at the top of the secondary reactor and spaced from the top of the coke charge. A carbon block is disposed at the bottom of the reactor in electrical contact with the coke charge. This permits maintaining both an arc between the electrode and the top of the coke charge and simultaneous resistive heating of the charge bed to incandescence. The raw product gas from the primary reactor is first subjected to the electrothermal and photochemical effects of the arc, and thereafter passed downwardly through the incandescent coke charge for further reaction and subsequent removal from the bottom of the secondary reactor in the form of a refined product gas comprised primarily of hydrogen, carbon monoxide and methane.

Other objects, features and advantages of the invention shall hereinafter become apparent from the following detailed description of a preferred embodiment thereof, when taken in conjunction with the single drawing figure.

BRIEF DESCRIPTION OF THE DRAWING

The single drawing FIGURE is a schematic representation of an apparatus used for the practice of a preferred embodiment of the invention.

DETAILED DESCRIPTION OF THE PREFERRED EMBODIMENT

In accordance with the practice of the invention, a feed of uniform or varied carbonaceous waste materials is exposed to an electric arc which causes thermal and photochemical degradation of the materials. The electric arc is of sufficient intensity to cause generation of radical species by homolytic bond cleavage. The materials contain hydrocarbons, carbohydrates and an abundance of water. All of these molecules are homolysed to radicals, with water homolysis being one of the predominant reactions based on the high hydrogen gas content of the product gas. The water homolysis reaction forms hydroxyl radicals and hydrogen atoms as shown by the following equation:

$$H_2O + h\nu \rightarrow H^{\bullet} + HO^{\bullet}$$

This reaction produces a potent reducing agent in the hydrogen atom and a potent oxidant in the hydroxyl radical. Both of these species react rapidly with the carbonaceous materials to generate additional radical species. The net result of these reactions is the conversion of the relatively high molecular weight hydrocarbon and carbohydrate materials in the feed into low molecular weight gaseous products, primarily carbon monoxide and molecular hydrogen. This occurs through the breaking of bonds between carbon atoms in the materials and the formation of bonds between carbon and oxygen, and between two hydrogens.

Another important aspect of the invention resides in the chain reaction nature of the chemistry. The radicals initially formed by the electric arc in turn form additional radicals by reaction with the feed materials in a chain reaction. It is the nature of such radicals that they are able to not only react with the feed materials to generate new radicals, but can also react with themselves. The combination of two hydrogen atoms to yield hydrogen molecules is representative of the radical recombination process which in urn results in a net reduction of the number of radicals.

The overall process can be divided into three stages, including the initiation stage wherein the number of radicals is increasing, the propagation stage in which the number of radicals remain essentially the same although the nature of the radicals may change, and the termination stage in which the number of radicals decreases. In the practice of the invention, the initiation stage occurs in the zone of the electric arc, wherein light and the electrothermal energy provided by the arc causes chemical bonds in the feed materials and water molecules to be broken in the production of radicals. These radicals will react with other feed molecules to form still more radicals and to cause the breakage of more chemical bonds in the propagation stage until the materials are reduced to relatively small molecules. As the materials are consumed by conversion into lower molecular weight compounds, the rate of generation of new radicals decreases. The radicals are dissipated by recombination, thereby causing product formation in the termination stage.

With reference to the single drawing figure, there is schematically shown an apparatus 1 utilized in the practice of a preferred embodiment of the invention. Apparatus 1 includes a primary reactor 3 comprised of an outer steel casing 5 and an interior lining 7 of refractory brick or similar material, which collectively define a reaction chamber 9 of vertical configuration. The bottom of chamber 9 forms a reservoir 10 which is maintained with a controlled quantity of water 11 by means of a valved water supply line 13. A valved discharge gate 15 is also provided at the bottom of chamber 9 for removing ash. A pair of opposed carbon electrodes 17 and 19 are slidably supported through appropriate journals 21 and 23, respectively, so that corresponding ends of electrodes 17 and 19 are disposed within chamber 9 and just above the level of water 11. Journals 21 and 23 are provided with appropriate gas seals. Electrodes 17 and 19 are provided with respective electrical connections 25 and 29 for connection to an appropriate electric power source.

The top portion of reaction chamber 9 is provided with a charging mechanism 30 that includes a feed hopper 31 which receives and feeds carbonaceous materials 33 into chamber 9 by means of an appropriate conveyor 35, such as a screw auger or the like, contained within a channel 36. Mechanism 30 is operated by a motor 37 which in turn is controlled by a sensor 39 disposed at an appropriate position adjacent the top portion of chamber 9. Sensor 39 may be of any type well known in the art and deemed suitable for the practice of the invention as described herein. In this way, the desired height level of carbonaceous materials 33 fed into chamber 9 can be constantly monitored by sensor 39 and maintained by mechanism 30. Hopper 31, conveyor 35 and channel 36 collectively define a gas seal when materials 33 are contained and compressed therein.

Primary reactor 3 also includes a raw product gas output line 41. Raw product gas generated in reactor 3 is conducted through line 41 to the top of a secondary reactor 45 which is similar to reactor 3 in construction and configuration. Secondary reactor 45 may also be comprised of an outer steel casing 47 and an inner lining of refractory brick 49 which collectively define a reaction chamber 51 of vertical configuration.

The top of secondary reactor 45 is provided with a single carbon electrode 53 which is slidably mounted within an appropriate gas seal journal 55 so that the end of electrode 53 may be positioned within chamber 51 at a desired level. The top of reactor 45 is also provided with a charge mechanism 56 including a hopper 57 and an appropriate conveyor 59 driven by a motor 61. In this case, hopper 57 should include an appropriate lock system for providing a gas seal so that gas is prevented from escaping through mechanism 56, particularly during its charging operation. Hopper 57 is filled with coke which is fed into chamber 51 so that a bed of coke 63 having a constant height level may be maintained within chamber 51. As shown, the terminal end of electrode 53 is spaced from the upper level of coke bed 63 a desired distance in order to permit the creation of an arc therebetween, as shall hereinafter be described.

The bottom portion of reactor 45 is provided with a block 65 of carbon material that is disposed in electrical contact with coke bed 63. Carbon block 65 is supported in place and electrically grounded by a metal bracket 67 and an appropriate ground connection 68. Accordingly, electrode 53 is also provided with an electrical connection 69. When an electric potential is applied across connections 67 and 69 by a suitable electric power source, arcing will occur between the end of electrode 53 within chamber 51 and the top of coke bed 63. Simultaneously, resistance heating will also occur throughout the height of coke bed 63. A product gas output line 71 is provided at the bottom portion of reactor 45 for removing refined combustible gases therefrom. Line 71 is preferably provided with an appropriate control valve means 73 therein. A valved discharge gate 75 is also provided at the lowermost portion of reactor 45 for ash removal.

Reactors 3 and 45 are schematically shown supported in raised positions by means of metal legs 77 and 79, respectively, or by other appropriate and well-known support means.

MODE OF OPERATION

The practice of the invention in the operation of apparatus 1 shall now be described with reference to the drawing. Charging mechanism 30 is used to charge and maintain a desired level of carbonaceous materials 33 in reaction chamber 9 of primary reactor 3. As materials 33 are consumed during the reaction, sensor 39 activates charging mechanism 30 to replenish materials 33, thereby always maintaining a constant level thereof in chamber 9. The presence of materials 33 within hopper 31 and channel 36 of mechanism 30 serve to form a gas seal and thereby prevent escape of reaction gases through mechanism 30. The level of water 11 at the bottom of chamber 9 is maintained approximately one to three inches below the arc established between the opposed ends of electrodes 17 and 19, with this level being maintained by supply line 13 as the water is vaporized by the arc.

The gasification reaction is initiated by applying an electrical potential across electrical connections 25 and 29 within the range of approximately 40 to 120 volts which, when maintained at electrodes 17 and 19, establishes a continuous electric arc therebetween. The intense heat of the arc creates and maintains an arc zone defined by an "arc pocket", indicated generally at P in the drawing, in the charge of materials 33. The materials 33 at the periphery of pocket P and the gases and vapors generated within pocket P are exposed to the resulting thermal and photochemical effects of the arc. The arc emanates high intensity light in the wavelength range between 1000 Å and 6000 Å, thereby creating arc effects which are sufficiently energetic to cause the generation of radical species by homolytic bond cleavage in the manner previously described herein.

In addition to the hydrocarbons and carbohydrates that are present in materials 33, there is also an abundance of water 11 evaporated from reservoir 10 at the bottom of chamber 9, with water homolysis thereby being one of the predominant reactions within arc pocket P, and results in the formation of hydroxyl radicals and hydrogen atoms in accordance with the previously indicated reaction equation. The hydroxyl radical, being a potent oxidant, and the hydrogen atom, being a potent reducing agent, function as species which react rapidly with hot carbonaceous materials 33 to generate additional radical species. These radicals, in turn, take part in chain reactions which, in the three successive stages previously described, serve to form new and smaller molecules by carbon bond cleavage. The net result is the nearly complete degradation and conversion of the carbonaceous materials 33 to the single carbon compound, carbon monoxide (CO). The hydrogen atoms involved in the process combine to yield hydrogen molecules.

These reactions take place in the lower portion of chamber 9 and towards which materials 33 are continuously moving during their consumption. The gases produced by the arc rise upwardly through the downward moving materials 33 in countercurrent heat exchange therewith, thereby initiating the early stage of a pyrolysis process at approximately the midlevel position of materials 33 within chamber 9. The products of the pyrolysis process include carbon dioxide, tars and gums which tend to deposit on the cool incoming materials 33. The resulting raw product gas from primary reactor 3 collected at the top of chamber 9 contains, in descending order of quantity, hydrogen, carbon monoxide, carbon dioxide, methane and traces of $C_2$ through $C_6$ hydrocarbon compounds. Moreover, the product gas typically carries those quantities of tars and gums which are not redeposited on the cool incoming materials 33 and, furthermore, may also entrain fine incoming particles of materials 33 from charging mechanism 30.

The raw product gas produced in primary reactor 3 is generally unsuitable for direct use because of its high (approximately 10%) carbon dioxide content, tar and gum content, and entrained fine particles of carbonaceous materials 33. For example, a typical raw product gas from primary reactor 3 operated with wood waste as the principal feed of carbonaceous materials 33 is composed of the following components:

| COMPONENT | MOLE % |
|---|---|
| Hydrogen | 44.16 |
| Carbon Monoxide | 38.28 |
| Carbon Dioxide | 11.64 |
| Methane | 5.28 |
| Ethane | 0.18 |
| Propane | 0.18 |
| Nitrogen | 0.09 |
| Isobutane | 0.07 |
| Hexanes Plus | 0.12 |
| | 100.00 |

The calculated gross BTU content of the above raw product gas is about 335, thus qualifying it as a medium BTU fuel gas. Refining of this raw product gas is accomplished by removing the gas from the top of chamber 9 through output line 41 and directing the gas to the top of secondary reactor 45. A bed of coke particles 63 is maintained at a constant level within reaction chamber 51 of reactor 45. When an electrical potential within the range of approximately 40 to 120 volts is applied across electrical connections 67 and 69 of carbon block 65 and electrode 53, respectively, a continous arc is maintained between the end of electrode 53 and the top of coke bed 63, with simultaneous resistive heating throughout entire coke bed 63. This causes bed 63 to be heated to incandescence. Raw product gas from line 41 is received within chamber 51 and is first subjected to the electrothermal and photochemical effects of the arc, and thereafter passed downwardly through the incandescent coke bed 63 for further reaction. This results in a reduction in carbon dioxide content to approximately half or less of its original percentage, with the carbon taking part in this reaction being derived from the breakdown of tars, gums and fine particles of carbonaceous materials contained in the raw product gas from primary reactor 3, and also from the incandescent coke bed 63. The refined product gas from reactor 45 is removed through output line 71 for storage and use. The composition of the refined product gas with wood wastes as the feed material has been shown to comprise the following:

| COMPONENT | MOLE % |
|---|---|
| Hydrogen | 64.49 |
| Carbon Monoxide | 26.33 |
| Carbon Dioxide | 5.72 |
| Methane | 2.38 |
| Ethane | 0.10 |
| Propane | 0.05 |
| Nitrogen | 0.90 |
| Isobutane | 0.01 |
| Hexanes Plus | 0.02 |
| | 100.00 |

In addition to the above, other test runs with apparatus 1 while using automobile tires and petroleum coke as the principal carbonaceous materials 33 resulted in refined product gases having the following compositions:

| COMPONENT | AUTOMOBILE TIRES (Mole %) | PETROLEUM COKE (Mole %) |
|---|---|---|
| Hydrogen | 51.48 | 43.78 |
| Carbon Monoxide | 32.92 | 47.76 |
| Carbon Dioxide | 3.04 | 5.71 |
| Methane | 8.49 | 0.31 |
| Ethane | 2.22 | 0.02 |
| Propane | 0.45 | 1.10 |
| Nitrogen | 0.35 | 1.04 |
| Isobutane | 0.75 | 0.20 |
| Hexanes Plus | 0.30 | 0.08 |
| | 100.00 | 100.00 |

The $CO_2$ content of the product gas is lowered in secondary reactor 45 according to the following chemical reaction:

$$CO_2 + C \rightarrow 2CO$$

As previously indicated, the carbon for this reaction may be derived from the tars, gums and fine entrained particles of carbonaceous material 33 in the raw product gas from primary reactor 3, or from the incandescent coke bed 63 in secondary reactor 45. The electrothermal and photochemical effects of the arc provide the activation of water vapor and organic radicals. These activated species and the incandescent coke bed 63 take part in the final refining reactions within reactor 45 which yield a refined product gas that is predominantly hydrogen and carbon monoxide, with low amounts of $CO_2$, $CH_4$ and minor amounts of other constituents, such as $C_2$ to $C_6$ hydrocarbon compounds. Secondary reactor 45 therefore functions as a refining unit to provide a refined product gas deemed suitable as a clean burning medium BTU fuel gas or as a synthetic gas for chemical industry applications.

The invention is further adaptable to the processing and destructive treatment of hazardous, hospital and various types of chemical waste materials. Such feed materials would undergo the same degree of destructive degradation as those materials previously described herein. For particularly hazardous waste materials, a tertiary reactor may be connected in series with secondary reactor 45 for further refining. Such a tertiary reactor shall have the same structural and functional characteristics as secondary reactor 45 and shall receive its incoming product gas from output line 71 of reactor 45. The tertiary reactor can be utilized as a safety backup device for braking down any remaining hazardous compounds which are detected by appropriate monitoring devices in output line 71 of reactor 45.

Water balance is an important factor in the operation of apparatus 1. For example, wood waste as the carbonaceous feed material commonly contains up to 55% water, an amount which is far in excess of the stoichiometric amount required for efficient gasification. Accordingly, wood waste can be dried prior to its introduction into apparatus 1. Otherwise, coke consumption in secondary reactor 45 may be more than desired. Similar considerations will also apply to refuse derived fuel (RDF). Moreover, when high sulfur coals are gasified, the sulfur appears in the product gas as hydrogen sulfide which can be removed from the gas by conventional processes to produce a commercial sulfur byproduct. The treated gas is a clean burning fuel suitable for combustion in power generating plants. In this way, the invention provides an efficient means for processing high sulfur coals since conventional stack gas treatment cost and pollution of the environment are significantly reduced or eliminated.

Although the invention has been described and illustrated herein with reference to a preferred embodiment and certain operating parameters, those skilled in the art will appreciate that various modifications, changes, additions, ommissions and substitutions may be made without departing from the spirit of the invention or scope of the subjoined claims.

What is claimed is:

1. A method of manufacturing combustible gaseous products from carbonaceous materials comprising the steps of:

a) providing a primary reaction chamber and maintaining a first electric arc zone at the bottom of the primary chamber, and providing a secondary reaction chamber containing an incandescent coke bed, each chamber being of a vertical configuration;

b) charging carbonaceous material into the top of the primary chamber and maintaining a substantially constant volume level of material above the first electric arc zone therein;

c) continuously moving the carbonaceous material downwardly through the primary chamber and into contact with the electric arc zone to electrothermally and photochemically activate the gasification of the material and produce a raw product gas therefrom;

d) passing the raw product gas upwardly through the downwardly moving carbonaceous material in countercurrent heat exchange therewith to initiate pyrolysis of the incoming material and produce a condensable product and a noncondensable product;

e) removing the raw product gas and noncondensable product from the top of the primary chamber and introducing same into the secondary chamber;

f) refluxing the condensable product with the downwardly moving carbonaceous material toward the bottom of the primary chamber, and g) passing the raw product gas and noncondensable product through the incandescent coke bed in the second chamber to produce a refined product gas comprised mainly of hydrogen and carbon monoxide.

2. The method of claim 1 further including the steps of maintaining a second electric arc zone at the top of the incandescent coke bed and subjecting the raw product gas to the electrothermal and photochemical effects of the second electric arc zone prior to passing the gas downwardly through the coke bed.

3. The method of claim 1 further including the step of maintaining a reservoir of water below the first electric arc zone to provide a source of water vapor during the gasification reaction.

4. The method of claim 1 wherein the step of maintaining a substantially constant volume level of carbonaceous material includes sensing the level of the material in the chamber and charging additional material into the top of the chamber when the level is below a predetermined value.

5. The method of claim 1 further including the step of heating the coke bed in the secondary reactor to incandescence by a combination of electric arc heating and electric resistance heating.

6. The method of claim 1 further including the step of maintaining the coke bed at a substantially constant volume level in the secondary chamber.

7. The method of claim 1 further including the steps of:

a) providing a tertiary rector of vertical configuration containing an incandescent coke bed; and b) passing the refined product gas from the secondary reactor through the incandescent coke bed of the tertiary reactor to produce a final product gas.

* * * * *

UNITED STATES PATENT AND TRADEMARK OFFICE

CERTIFICATE OF CORRECTION

PATENT NO. : 5,069,765

DATED : December 3, 1991

INVENTOR(S) : Arlin C. Lewis

It is certified that error appears in the above-identified patent and that said Letters Patent is hereby corrected as shown below:

Column 3, line 57, "urn" should be --turn--.

Column 8, line 15, "braking" should be --breaking--.

Signed and Sealed this

Twenty-fifth Day of February, 1992

*Attest:*

HARRY F. MANBECK, JR.

*Attesting Officer*

*Commissioner of Patents and Trademarks*